US008365566B2

(12) United States Patent
Langer et al.

(10) Patent No.: US 8,365,566 B2
(45) Date of Patent: Feb. 5, 2013

(54) DEVICE FOR ADJUSTING THE DISTANCE OF A STRIPPER CHISEL

(75) Inventors: Hendrik Langer, Schmallenberg (DE); Christian Hehmann, Wilnsdorf (DE)

(73) Assignee: SMS Siemag AG, Dusseldorf (DE)

( * ) Notice: Subject to any disclaimer, the term of this patent is extended or adjusted under 35 U.S.C. 154(b) by 407 days.

(21) Appl. No.: 12/676,247

(22) PCT Filed: Aug. 15, 2008

(86) PCT No.: PCT/DE2008/001356

§ 371 (c)(1),
(2), (4) Date: Mar. 3, 2010

(87) PCT Pub. No.: WO2009/033445

PCT Pub. Date: Mar. 19, 2009

(65) Prior Publication Data

US 2010/0199735 A1 Aug. 12, 2010

(30) Foreign Application Priority Data

Sep. 10, 2007 (DE) ..... 10 2007 044 569
Oct. 8, 2007 (DE) ..... 10 2007 048 747

(51) Int. Cl.
*B21B 27/06* (2006.01)
*B21B 37/74* (2006.01)

(52) U.S. Cl. ..... 72/201; 72/227; 72/236; 72/237; 72/245; 72/246; 72/250

(58) Field of Classification Search ..... 72/43, 44, 72/45, 201, 227, 236, 237, 245, 246, 250, 72/200, 202
See application file for complete search history.

(56) References Cited

U.S. PATENT DOCUMENTS

| | | | | |
|---|---|---|---|---|
| 4,096,725 | A * | 6/1978 | Kano | 72/250 |
| 4,403,492 | A * | 9/1983 | Hope | 72/201 |
| 4,577,482 | A * | 3/1986 | Greenberger | 72/201 |
| 4,974,437 | A * | 12/1990 | Schiller | 72/236 |
| 5,517,842 | A * | 5/1996 | Ginzburg | 72/201 |
| 7,882,719 | B2 * | 2/2011 | Schulmeister et al. | 72/201 |
| 8,051,693 | B2 * | 11/2011 | Giesler et al. | 72/236 |

FOREIGN PATENT DOCUMENTS

| | | |
|---|---|---|
| DE | 26 27 162 | 12/1976 |
| DE | 33 12 009 | 10/1984 |
| DE | 199 46 946 | 4/2001 |

* cited by examiner

*Primary Examiner* — David B Jones
(74) *Attorney, Agent, or Firm* — Cozen O'Connor

(57) ABSTRACT

A device for adjusting the distance of stripper chisels from a circumference of work rolls supported in chocks of a roll stand, wherein the stripper chisels are movable parallel to the rolling line in direction towards and away from the roll gap. To adapt to different operating positions and diameters of the work rolls, the stripper chisels are arranged in a horizontally displaceable stand roller table. The movement of the stand roller table is linked with the vertical movement of the bottom work roll so that the stripper chisel can be moved away from the work roll when the bottom work roll moves upward, and vice versa.

10 Claims, 1 Drawing Sheet

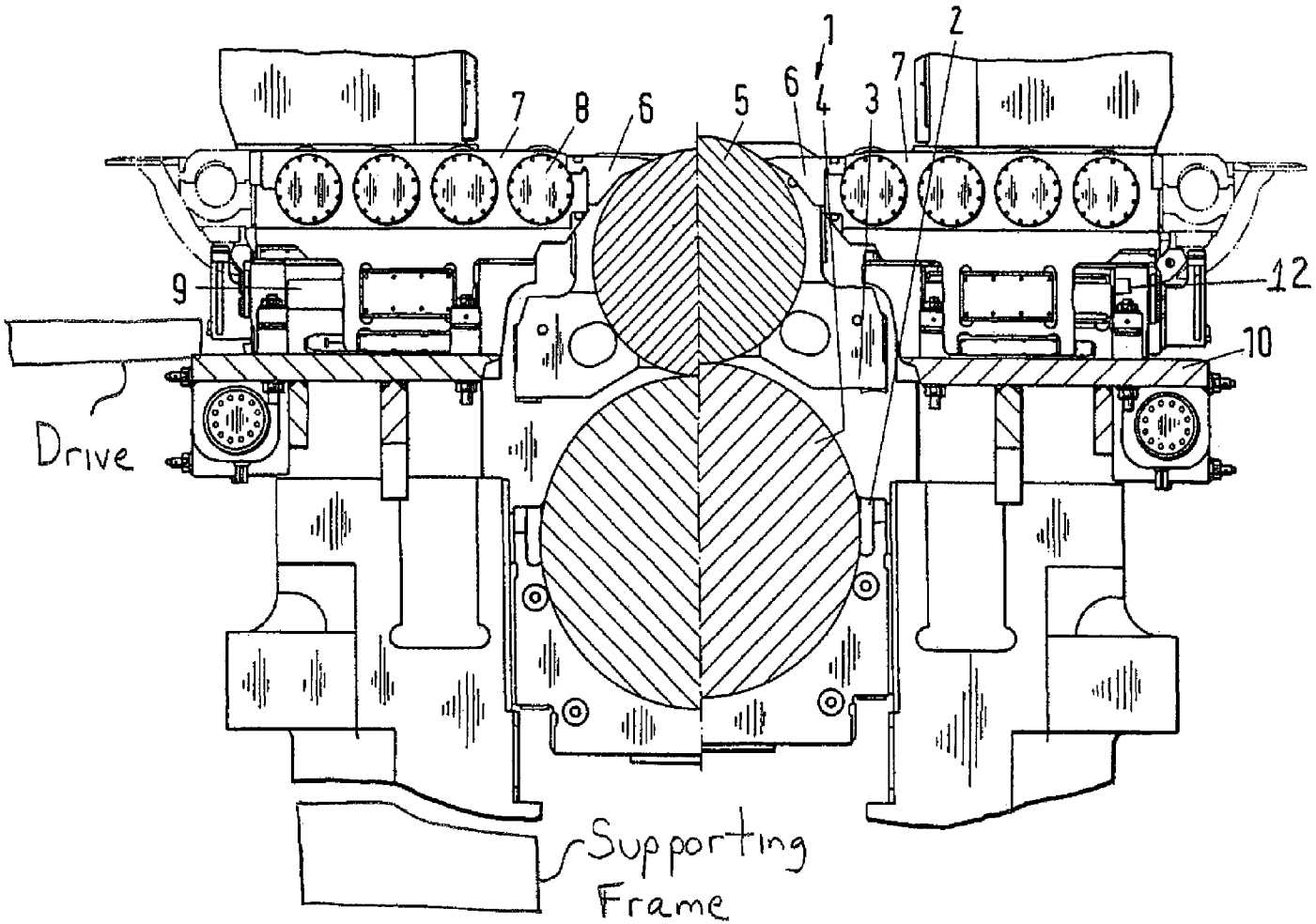
12
10
2
7
3
1
4
6
5
6
8
7
9
Drive
Supporting Frame

DEVICE FOR ADJUSTING THE DISTANCE OF A STRIPPER CHISEL

PRIORITY CLAIM

This is a U.S. national stage of application No. PCT/DE2008/001356, filed on Aug. 15, 2008, which claims Priority to the German Application Nos.: 10 2007 044 569.7, filed Sep. 10 2007 and 10 2007 048 747.0, filed Oct. 8, 2007, the contents of all of which being incorporated herein by reference.

BACKGROUND OF THE INVENTION

1. Field of the Invention

The invention is directed to a device for adjusting a distance of stripper chisels from a circumference of work rolls supported in chocks of a roll stand, wherein the stripper chisel is movable parallel to a rolling line in direction towards and away from the roll gap.

2. Prior Art

Stand roller tables are conventionally used in hot rolling reversing stands and ensure a transfer of rolling stock from a work roll to a downstream roller table and to the work roll from the upstream roller table. Passage of the rolling stock from the work roll to the stand roller tables is generally carried out over a stripper chisel fastened between the work roll chocks or is integrated in the stand roller table.

An example of a displaceable stripper chisel is known from DE 33 12 009 A1.

In wide roll stands (rolling stock wider than 3500 mm), experience has shown that fastening the stripper chisel between the work roll chocks can cause problems. The shape of the chisels must conform to the free space between the work roll and the work roll chock, i.e., the section modulus of the chisels is limited and cannot always be constructed to conform to requirements. As a result, the chisels can be bent or are even completely destroyed due to loading by the rolling stock to the extent that the chisels come into contact with the work roll. If special requirements are imposed on the chisels because of a large rolling stock width, a heavy rolling stock weight, or special stressing such as in aluminum stands, the chisels are integrated in the stand roller tables so that they can be constructed to be more rigid and robust.

When the stripper chisels are installed between the work roll chocks, the position of the chisel is adapted to the different roll diameters by various inserts so that it is possible to adjust a constant gap between the work roll and the chisel. The chisels remain in a fixed position in relation to the work roll during operation and move up or down with the bottom set of work rolls when an adjustment is carried out in the passline, e.g., by a hydraulic adjustment below in the stand. As a result, the position of the chisel changes in relation to the stand roller table, since the stand roller tables are mounted in a fixed position in the stand. The changing distances between chisel and stand roller table can lead to problems in the transfer of rolling stock, especially when special requirements are imposed in this respect, e.g., as in aluminum roll stands.

When the stripper chisels are integrated in the stand roller table, the design of the chisels is optional with respect to their section modulus, so that they are capable of absorbing high loads resulting from the rolling process.

SUMMARY OF THE INVENTION

There is not yet a solution which would make it possible to adjust the gap between the work roll and stripper chisel to be constant in every operating position when the position of the bottom work roll changes during rolling operation, e.g., due to a hydraulic adjustment below in the stand.

It is an object of the present invention to integrate the stripper chisel in the stand roller table and, in so doing, be able to adapt the position of the chisel to different operating positions and diameters of the work rolls so that the gap between the chisel and roll can be kept constant.

This object is met according to one embodiment of the invention in that the stripper chisel is arranged at a horizontally displaceable stand roller table, wherein the movement of the stand roller table is linked with the vertical movement of the bottom work roll so that the stripper chisel can be moved away from the work roll when the bottom work roll moves upward, and vice versa.

The invention makes it possible to integrate the stripper chisel for the transfer of rolling stock in the stand roller table while adjusting a constant gap between the roll and chisel in every position of the bottom work roll. According to one embodiment of the invention, it is possible to select a position of the stand roller table depending on the position of a bottom hydraulic adjustment. Accordingly, the different work roll diameters and different positions of the bottom work roll determined by the bottom hydraulic adjustment can be taken into account when positioning the chisel.

This specific requirement derives from the operating conditions present, e.g., in an aluminum reversing stand with a maximum rolling stock width of 4000 mm, a maximum rolling stock weight of 20 tons and a hydraulic adjustment below in the stand. Aluminum has the characteristic that it tends to adhere to metallic surfaces in heated state. As a result, the stripper chisel must be brought toward the work roll in aluminum roll stands with a small gap (approximately 3 mm) to ensure that the rolling stock detaches from the roll and does not run into the gap between the chisel and work roll.

Further, rolling stock residues must be stripped away from the work roll. As a result, the chisel is exposed to high stresses and must be correspondingly rigid. Further, stripping of rolling stock residues from the work roll must be ensured in substantially every operating position so that the required gap is adjustable in substantially every position. To adjust different passlines, roll stands are outfitted with a hydraulic adjustment below in the stand that makes it possible to raise and lower the upper edge of the bottom work roll to different levels. Aside from the adjustment of the passline, the hydraulic adjustment also makes it possible to regulate the rolling stock thickness, i.e., the thickness of the rolling stock can be adjusted continuously over the entire length of the rolling stock within certain tolerances. The thickness control is carried out continuously during rolling operation so that the position of the bottom work roll is subject to continual change. This change in position of the bottom work roll must be taken into account when adjusting the gap relative to the chisel.

The invention will be described in the following with reference to an embodiment example.

BRIEF DESCRIPTION OF THE DRAWINGS

FIG. 1 shows a schematic partial view of a roll stand with different adjustments of the bottom work roll and backup roll.

DETAILED DESCRIPTION OF THE DRAWINGS

The roll stand is shown only partially depicted and is designated by 1. The backup roll 4 and the work roll 5 are supported in this stand, in chocks 2 and 3.

The rolls 4 and 5 can be adjusted to the rolling line, for example, by hydraulic cylinders.

The stand roller tables, according to the invention, with the base frame 7, stand rollers 8 and stripper chisels 6 are shown on both sides of the work roll 5.

The horizontal adjustment or displacement of the stand roller table is carried out by means of the adjusting devices 9.

The entire stand roller table can preferably be constructed, from two structural component parts: a swivel frame 10 mounted at the roll stand and a stand roller table comprising a base frame 7 on which the individual stand rollers 8 and stripper chisel 6 are mounted.

A construction in which a supporting frame is fastened to the roll stands, the stand roller table being displaceably arranged therein, is also possible. The supporting frame can be formed of one or more parts. In the embodiment mentioned above, the stand roller table is arranged so as to be horizontally displaceable in the swivel frame. In both constructions, the displacement can be measured by one or more position sensors 12.

The position sensors 12 make it possible to exactly determine the actual position of the stand roller table so that it is possible to integrate them in a position control. This position control is linked with the position controls of other components in the stand so that the stand roller table is always located in a substantially optimal position with respect to the work rolls. The stand roller table and, therefore, the stripper chisel 6 move outward, away from the work roll 5 when the bottom work roll 4 moves up, and vice versa. To change the work rolls, the stand roller table is displaced into its outermost position to ensure that there cannot be a collision between the chisel 6 and the work roll chocks 2, 3 when the work roll sets are moved out.

The invention can be used in any rolling mills which are outfitted with a stand roller table and in which special requirements are set with respect to the transfer of rolling stock from the work roll to the stand roller table.

The horizontal displacement of the stand roller table can be achieved, for example, by a hydraulic adjusting device. Other drives, e.g., electrically operated threaded spindles, are also possible.

As was mentioned above, the horizontal movement or displacement of the stand roller table is linked with the vertical movement of the bottom work roll. By this is meant that an electrical or mechanical coupling of the two types of movement is possible structurally.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A device in a roll stand comprising:

a vertically upper chock configured to support a vertically upper work roll;

a vertically lower chock configured to support a vertically lower work roll;

a stand roller;

a stripper chisel coupled to the stand roller configured to be movable parallel to a rolling line in a direction towards and away from a roll gap to adjust a distance of a stripper chisel from a circumference of the vertically upper work roll; and a horizontally displaceable stand roller table comprising a base frame and at least one stand roller arranged in the base frame, the stripper chisel affixed to the base frame, wherein movement of the stand roller table is linked with a vertical movement of the vertically lower work roll so that the stripper chisel is moved away from the work roll when the vertically lower work roll moves upward, and vice versa.

2. The device according to claim 1, wherein the stand roller table contains a plurality of rollers displaceably mounted in the base frame.

3. The device according to claim 2, wherein a drive of the plural stand rollers is constructed as one of a group drive and an individual drive.

4. The device according to claim 1, wherein the stand roller table further comprises a swivel frame mounted at the roll stand.

5. The device according to claim 1, wherein the stand roller table is arranged in a supporting frame fastened to the roll stand.

6. The device according to claim 4, further comprising at least one position sensor, wherein the stand roller table is arranged horizontally displaceable in one of the swivel frame and the supporting frame, wherein a displacement path is measured by the at least one position sensor.

7. The device according to claim 6, wherein position control is configured to be linked with a position control of one or more components coupled to the stand so that the stand roller table is located in a determined position with respect to the bottom work roll.

8. The device according to claim 1, wherein the horizontal movement of the stand roller table is mechanically coupled with the vertical movement of the vertically lower work roll so that the stand roller table is always in a determined position with respect to the bottom work roll.

9. The device according to claim 1, wherein, in order to change the work rolls, the stand roller table is displaceable into a spaced apart position so that a collision between the chisel and the vertically upper and vertically lower work roll chocks is prevented when the vertically upper and vertically lower work roll sets are moved vertically.

10. The device according to claim 1, further comprising a second stripping chisel arranged parallel to the stripping chisel and arranged on opposite sides of the work roll.

* * * * *